US005259087A

United States Patent [19]

Loveless et al.

[11] Patent Number: 5,259,087

[45] Date of Patent: Nov. 9, 1993

[54] ASH VACUUM

[76] Inventors: Michael L. Loveless; Colleen G. Loveless, both of 449 E. 200 North, Price, Utah 84501

[21] Appl. No.: 813,784

[22] Filed: Dec. 27, 1991

[51] Int. Cl.[5] ..... A47L 9/20

[52] U.S. Cl. ..... 15/327.6; 15/347; 15/352; 15/327.2; 55/305; 55/304

[58] Field of Search ..... 15/352, 347, 327.1, 15/327.6, 347, 327.2, 327.7; 55/300, 304, 305, 299

[56] References Cited

U.S. PATENT DOCUMENTS

| | | | |
|---|---|---|---|
| 897,342 | 9/1908 | Boegel | 55/305 |
| 2,077,572 | 4/1937 | Lofgren | 55/305 |
| 2,211,934 | 8/1940 | McAllister | 55/305 |
| 2,372,944 | 4/1945 | Forsberg | 55/305 |
| 3,358,316 | 12/1967 | Okun | 15/327.6 |
| 3,568,413 | 3/1971 | Jerabek | 15/327.6 |
| 3,653,190 | 4/1972 | Lee et al. | 15/327.1 |
| 4,072,483 | 2/1978 | Doyle, Jr. | 15/347 |
| 4,342,131 | 8/1982 | Reid | 15/327.6 |
| 4,355,434 | 10/1982 | Gongwer | 15/327.1 |
| 4,704,764 | 11/1987 | Metelko, Jr. | 15/352 |
| 4,868,949 | 9/1989 | Loveless et al. | 15/352 |
| 5,090,083 | 2/1992 | Wulff | 55/305 |

FOREIGN PATENT DOCUMENTS

| | | | |
|---|---|---|---|
| 294501 | 7/1928 | United Kingdom | 55/305 |
| 421664 | 12/1932 | United Kingdom | 15/327.1 |
| 449828 | 7/1936 | United Kingdom | 55/305 |
| 653033 | 5/1951 | United Kingdom | 15/327.1 |
| 2219524 | 12/1989 | United Kingdom | 15/353 |

*Primary Examiner*—Timothy F. Simone
*Assistant Examiner*—Gary K. Graham
*Attorney, Agent, or Firm*—M. Reid Russell

[57] ABSTRACT

A vacuum consisting of a canister housing that is open across its top end and is arranged to be covered by a removable lid, which lid mounts a vacuum source. The canister housing includes a hose port for connection to a hose that mounts a nozzle on the end thereof, which hose and nozzle are preferable formed of a fireproof or flame retardant materials that will not be damaged by a passage of warm, hot and even burning coals therethrough. Which canister housing can be mounted on wheels, casters, or the like. A double filter system of the present invention is arranged within the canister housing, attached to the lid undersurface, to extend across the vacuum source inlet, which filter system consists of an inner or secondary filter for closely fitting across the vacuum source inlet, and is primarily a dust filter, with an outer or primary filter mounted to the lid, over the inner or secondary filter, with an open box frame arranged therebetween. Which open box frame includes a rod extending therefrom and out from the lid that is for shaking by an operator for dislodging by contact with collected materials off from the inner or secondary filter surface and from the outer or primary filter, which outer or primary filter is formed as a bag, preferably from a resistant or retardant proof material.

4 Claims, 2 Drawing Sheets

ASH VACUUM

BACKGROUND OF THE INVENTION

1. Field of the Invention

The present invention relates to vacuum cleaners for removing burned materials, including even still hot materials, out of a fireplace or stove, and particularly to flame retardant filter systems for such vacuum cleaners.

2. Prior Art

Removal of ashes and unburned materials from wood burning fireplaces and stoves is often a difficult and messy task for users of such devices. Particularly should live coals be present in such removed materials that can cause damage to conventional vacuum cleaners, and may even constitute a fire hazard. An earlier ash vacuum adapter of the present inventors, U.S. Pat. No. 4,868,949, shows a canister arrangement for connection to a vacuum source for drawing ashes and coals into a canister. Which arrangement employs a filter formed of a fire retardant material and provides a rod for shaking which filter from without the canister. Distinct from this earlier adapter, the present invention includes an integral vacuum source and provides a duel inner and outer filter system that includes an open frame for supporting the outer filter element. Which invention also provides a rod arrangement connected to the open frame and extending beyond the canister for shaking that frame from without the unit, dislodging materials collected on both the inner and outer filters that fall therefrom.

Functionally similar to the adapter device of U.S. Pat. No. 4,868,949, patents to Rasmussen, U.S. Pat. No 4,476,608, and Natale, U.S. Pat. No. 4,613,345, shown devices for connection to a vacuum source for pulling dust, ashes, or like materials, therein and involve filter arrangements. Unlike the present invention, however, the Rasmussen Patent shows only a divider wall for filtering heavy particles out of an air flow, and the Natale patent shows a disposable filter element. Additionally, a United Kingdom Patent to Ruau, No. 294,501, shows a filter element for connection to a vacuum source wherein a single filter element is maintained around a spring structure with a bottom plate connected to a shaker rod. The manual movement of which rod is to shake off materials collected on that filter surface. Which Ruau patent, however, does not include a self contained vacuum source, nor does it involve a pair of inner and outer filter elements separated by a box frame filter element retainer of the present invention.

Heretofore, a number of canister suction or vacuum type cleaners have been developed, with some suitable for ash collection. For example, an early canister vacuum, identified as a dust separator, is shown in a patent to Bieth, U.S. Pat. No. 1,946,665, that provides a baffle arrangement for separating particles out of an air flow. A patent to Bryan, U.S. Pat. No. 3,910,781, also shows a vertical or canister type vacuum cleaner with an internal, dust separating filter, which filter, however, appears to be rigidly maintained as an upright cone, and does not include structure for shaking materials therefrom. A canister type suction cleaner is also shown in a patent to Gongwer, U.S. Pat. No. 4,355,434, that is arranged for ash removal, as from a fireplace, and includes both a baffle structure as well as a filter, but does not involve a flexible outer filter that can be shaken from without the device.

Like the above cited Gongwer patent, patents to Raminger, U.S. Pat. No. 2,531,920, and Reid, U.S. Pat. No. 4,342,131, show vacuum cleaners for removal of ashes and unburned materials from fireplaces and stoves. Neither of these cleaners, however, employs a filter system and an arrangement for shaking an outer filter element thereof like that of the present invention. Another cleaner devices that is also intended for cleaning fireplaces, but does not include a filter structure and shaking arrangement like that of the present invention, is shown in a patent to Fullenwider, U.S. Pat. No. 4,363,674.

SUMMARY OF THE INVENTION

It is a principal object of the present invention in an ash vacuum to provide a canister type vacuum cleaner that is useful for safely removing ashes and hot and even burning coals from a wood burning fireplace or stove.

Another object of the present invention is to provide a canister type vacuum cleaner with a double filter system that includes an open filter frame arranged therebetween, with a shaker rod connecting to which frame and extending out of the canister for manual movement to shake collected materials off from both the inner and outer filters.

Another object of the present invention is to provide a primary or outer bag type filter that is formed from a flame retardant material that allows hot and even burning coals to be pulled into the cleaner without presenting a fire hazard, which filter prohibits passage of materials to the inner or secondary filter and vacuum source inlet.

Still another object of the present invention is to provide, with a canister type vacuum cleaner, a filter assembly that both protects the vacuum source from receipt of collected materials, even hot or burning coals, and provides an operator with a capability for shaking, from without the canister, the primary filter, and scraping the inner of secondary filter dislodging collected materials from each filter.

Still another object of the present invention is to provide a canister type vacuum cleaner that is easy and safe to use for removal of ashes and coals, and even hot or burning coals, from a wood burning fireplace or stove.

The present invention is a canister type vacuum cleaner that includes a pail or barrel housing, that may be mounted on casters, wheels, or the like, and includes a lid for releasably fitting over an open top end thereof. The lid mounts a vacuum source, preferably an electric motor, turning a fan, that creates an air flow to pull materials into which canister through an inlet hose. A filter system of the present invention is mounted across the vacuum inlet within the canister and consists of a separately mounted interior or secondary filter secured across the vacuum pump inlet, with an outer or primary bag type filter, containing a box filter frame, arranged between which outer or primary bag filter and interior or secondary filter.

The box filter frame both provides for spacing between the primary bag filter and secondary filter and connects to a rod that extends past the vacuum source and out of the lid top. Which rod is for manual manipulation by an operator for shaking that frame and the bag type primary filter, and scraping the surface of the inner of secondary filter dislodging materials from which filter. Which dislodged materials off from the inner filter fall to the outer filter, and from the outer filter into the canister. A rod cover is provided for positioning over the rod end for maintaining the vacuum within which canister, which cover is easily removable by an operator to allow shaking of which rod and connected box filter frame.

The ash vacuum of the present invention is intended to be utilized in the removal of ashes and coals, even hot and smoldering coals, and to this end includes a hose manufactured from fire resistant material wherethrough the collected materials are drawn. Further, the primary filter is formed of fire proof or retardant material, as it may be exposed to burning coals. In practice, a fiberglass material has been used to manufacture which primary filter. A polyester material has satisfactorily been used as the secondary filter. Which material also restricts fine particulate passage into the vacuum source.

Ring clamps are utilized for releasably mounting both the primary and secondary filters across the vacuum source inlet. Which vacuum source is preferably a conventional vacuum motor driving a fan as is suitable for use with in a canister type vacuum and, in practice, a unit manufactured by G. S. Electric, has been so utilized. As set out above the vacuum motor and pump are preferably mounted to a lid that is arranged for releasable mounting, as with lid clamps, across an open end of a metal pail or drum that is utilized as the canister housing.

BRIEF DESCRIPTION OF THE DRAWINGS

These and other objects and features of the present invention will become more apparent from the following description in which the invention is described in detail in conjunction with the accompanying drawings.

DETAILED DESCRIPTION

Figure 1:
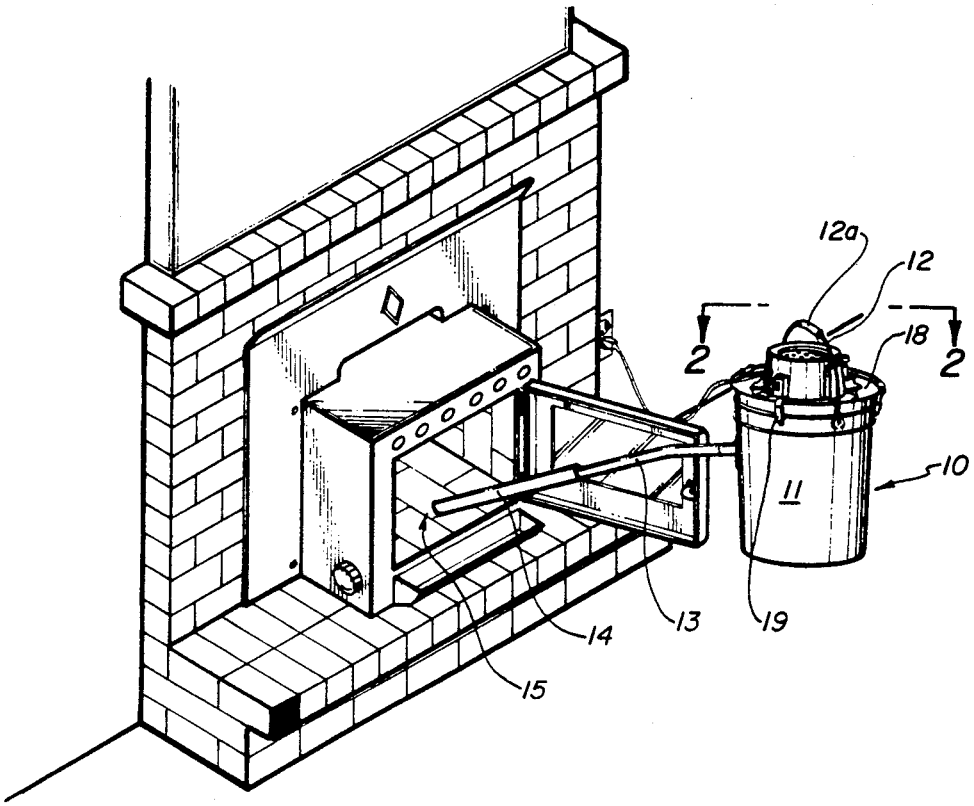
FIG. 1 is a perspective view of an ash vacuum of the present invention showing a vacuum hose extending from a canister housing with a nozzle end thereof positioned inside a fireplace.

FIG. 1 shows a preferred embodiment of the present invention in an ash vacuum 10. The ash vacuum 10 includes a canister housing 11, that is shown as a pail having a movable wire handle 12, with a hand grip 12*a*. A hose 13 is shown extending from the canister side with a nozzle 14 fixed to the hose end. The nozzle 14 is shown positioned in a conventional fireplace 15, illustrating the present invention being used to remove ashes and coals from that fireplace.

Figure 2:
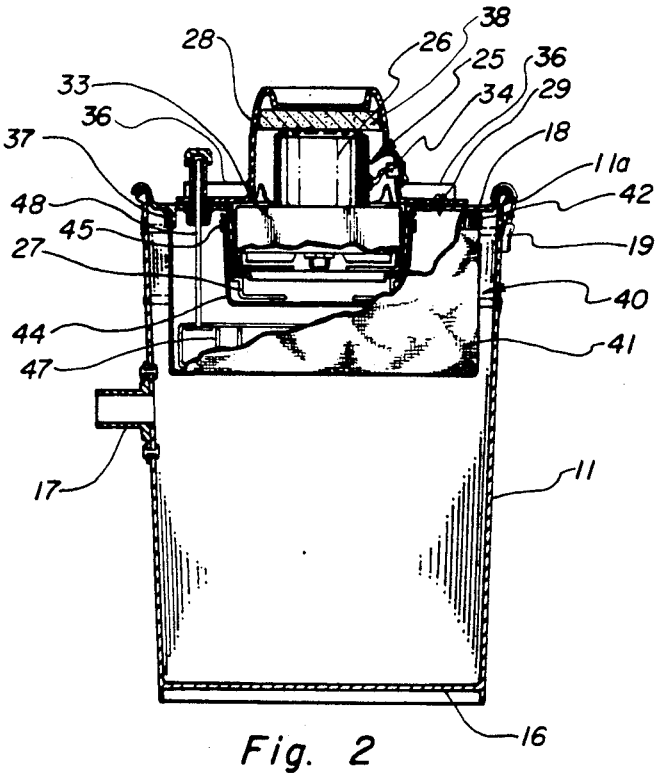
FIG. 2 is a side elevation sectional view taken along the line 2—2 of FIG. 1, showing the canister housing interior with a section of an outer or primary filter covering the vacuum source inlet shown broken away.

FIG. 2 shows a profile sectional view of the interior of the canister housing 11 of the ash vacuum 10 of FIG. 1, that is shown as having a closed bottom 16. A hose port 17 extends outwardly from the canister housing side, that is for receiving and coupling the hose 13 thereto. The open canister housing top is shown closed by a removable lid 18, that is releasably maintained in covering engagement to the canister housing by clamps 19. Which clamps 19 are each shown best in FIG. 3 as including a body 20 that is pivotally coupled by a pin 21 to the canister side, adjacent to a top lip 11*a* thereof, with the other body 20 end pivotally mounting a wire hook 22. For clamping the lid 18 onto the canister housing top lip 11*a*, the wire hook 22 end is pivoted to travel over the lid edge 18*a* and the body 20 is pulled between parallel sides of which wire hook into engagement with the canister side. The lid is thereby clamped, in sealing engagement to the canister housing lid along the lid edge. Which coupling can include a ring seal, gasket, or the like, arranged between which lid edge and the lip of the canister top.

Figure 3:
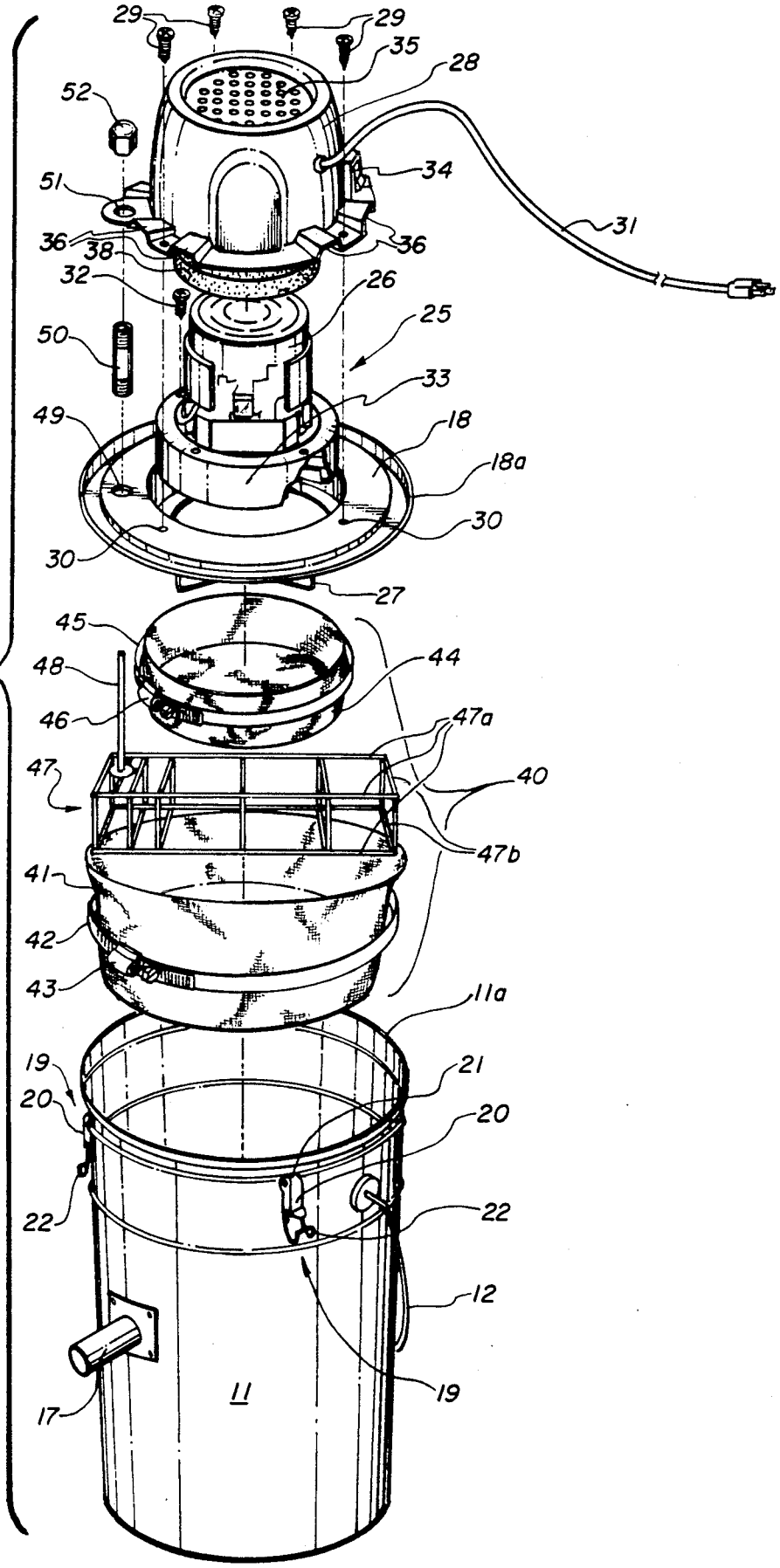
FIG. 3 is an exploded profile perspective view of the ash vacuum of FIG. 1.

Shown in FIGS. 2 and 3, a vacuum source 25 is mounted to the center of the top of lid 18, which vacuum source includes an electric motor 26 turning a fan 27. The vacuum source may be a commonly used commercially available unit, and a motor and fan arrangement manufactured by G. S. Electric, has been found in practice to be suitable for such use. A cover 28 is provided for fitting, in covering arrangement, over the electric motor 26. In which covering attitude screws 29, as shown in FIG. 3, are aligned to be turned into holes 30 that are formed in the lid for mounting the cover thereto. An electrical power cord 31 that has a plug end for coupling into a house current source and is to provide power to the electric motor is fitted through the cover 28 for supplying power to electric motor 26. A screw 32 is provided for turning into a hole formed in the top side of the motor for ground wire mounting, and a switch 34 is connected electrically into the power source for routing, when switched on, electrical power to that electric motor 26.

An air flow is pulled from the canister housing 11 interior by the turning of the fan 27, which air flow passes into the electric motor 26 through holes in a screen 35 of a cover 28 which, in fact, air flow has passed through a center of a foam seal 38 positioned around the motor top for prohibiting air passage from the canister housing and into the motor air inlet and is heated out of vents 36, creating a vacuum to an air flow through the nozzle 14 end, through hose 13 and hose port 17 from the canister housing 11.

A double filter system 40 of the present invention is arranged within the canister housing 11 to separate that canister interior from the vacuum source. Which filter system 40 consists of an outer or primary filter 41, shown as a wide mouth bag that has an open neck that is to be maintained around a lid continuous footing 37, that, as shown best in FIG. 2, extends downwardly as a wall from the lid 18 undersurface, Which mounting includes a ring clamp 42 that is fitted over which primary filter neck and the footing 37. A turning of a screw tightener 43 of which ring clamp 42 cinches the ring clamp tightly around which footing, clamping the filter neck thereagainst, as shown best in FIG. 2. The primary filter 41 is preferably formed from a flame proof material that will not burn should even very hot or burning coals be pulled into the canister housing 11, or should even such coals continue to burn in which canister housing. In practice, a fiberglass material has been used successfully for manufacture of the primary filter 41.

Before mounting which primary filter 41, an inner or secondary filter 44 is secured around a cylindrical bottom end surface of the motor bracket 33. Which secondary filter 44 is for fitting tightly around and over the motor bracket 33 that is the vacuum source inlet. A ring clamp 45 is provided as the secondary filter mounting that is operated by appropriately turning a screw tightener 46 thereof, to cinch which ring clamp tightly around the neck area of which secondary filter 44, clamping it against which motor bracket 33 cylindrical surface. The secondary filter 44 is preferably formed from a close mesh material with a slick outer surface for prohibiting even fine particulates from passing through that filter and into the electric motor, and a polyester material has been used successfully for this application.

Shown best in FIG. 3, the primary filter 41 has a greater internal area than the outer surface area of the secondary filter 44. There is, accordingly, an open area or space between which filters. Which space, as shown, receives an open box frame 47 positioned therein that has a rod 48 connected at a top edge. The rod 48 extends upwardly from a top of which open box frame 47 and passes through a hole 49 formed through the lid 18. The rod 48 is to receive a sleeve 50 that is fitted thereover and is turned into which lid hole 49 to provide a sealed condition. Which sleeve receives a cap 52 turned onto its end, closing which sleeve end. The sleeve 50 is turned out of the lid hole 49 for providing operator access to the rod 48 for shaking that rod and connected open box frame 47 to shake also the primary filter 41. And also bumping the secondary filter 44 surface.

The shaking by an operator of the rod 48 and connected open box frame 47 shakes the primary filter 41 and scrapes the secondary filter 44 surface tending to dislodge materials from the outer surface of which primary filter and materials as have been pulled through the filter and deposited on the secondary filter outer surface. Which materials fall off the primary filter surface and into the bottom of the canister housing 11 and off the secondary filter outer surface falling to the bottom of which primary filter. To allow free passage of materials off from the secondary filter outer surface into the filter bottom area, the box frame is arranged as an open frame. As shown in FIG. 3, the open box frame 47, that can be metal or a heat resistant plastic is preferably formed by connecting, as by application of an adhesive, welding or brazing, horizontal rod sections 47*a*, at right angles to vertical rod sections 47*b*, forming the open box frame. Materials shaken off the secondary filter fall to the end of the primary filter and are later removed as by demounting the primary filter off from the footing 37. Which particles will not pass through the secondary filter 44. Additional to the shaking of the open box frame 47 to dislodge particles off from the outside surface of secondary filter 44, that shaking, of course, also dislodges materials off from the outer surface of which primary filter, which materials fall to the bottom of canister housing 11 and are removed when the canister housing is emptied.

While not shown, it should be understood that the canister housing 11 can mount wheels, casters, or the like to its bottom end for providing mobility thereto. Further, where the hose nozzle 14 has not been shown in detail herein, it should be understood that it is preferably formed to be flame proof, as from a metal, and includes some type of restricted orifice end to discourage large coals from being pulled therethrough. Also, where the hose 13 construction has not heretofore been discussed, it should be understood that it is preferably formed from a flame proof or retardant material that will not be damaged should a hot or even a burning coal be pulled into which hose.

While a preferred form of our invention in an ash vacuum has been shown and described herein, it should be understood that the present disclosure is made by way of example only and that variations are possible without departing from the subject matter, and reasonable equivalency thereof, coming within the scope of the following claims, which claims we regard as our invention.

We claim:

1. A vacuum comprising, a housing having a closed bottom and open top ends; a lid for fitting, in sealed engagement over said housing open top end, said lid having an undersurface facing the housing, a vacuum source inlet opening therefrom, and latch means for securing, in sealing engagement, said lid onto said housing top end; a vacuum inlet tube secured into said housing for mounting a vacuum hose thereto, said vacuum hose having two ends and mounting a nozzle onto one end with the other vacuum hose end mounted to said vacuum inlet tube; a filter system and means for mounting same to said lid undersurface across said vacuum source inlet, said system consisting of a first primary filter that is a bag formed of a flame resistant material, a neck of said bag mounting to said lid undersurface and surrounding therein an inner secondary filter of bag form, a neck of said inner secondary filter mounting around said vacuum source inlet; an open box frame that is formed from rod section joined at their ends at right angles into a rectangular shape with opposite parallel rectangular ends with rod sections extending therebetween for arrangement between said primary filter and said inner secondary filter; a straight rod having two ends, one of said ends connected at a right angle to one of said open box frame ends providing a cantilever mounting of said open box frame to said straight rod, and said straight rod extends through an opening in said lid for manually lifting, rocking and pivoting said open box frame; and means for sealing said rod opening through said lid.

2. A vacuum as recited in claim 1, wherein the inner secondary filter is formed from foam plastic material and is secured, in tight fitting engagement, over the inlet of the vacuum source; and said inner secondary filter receives a ring clamp fitted around the neck thereof for mounting said inner secondary filter across said vacuum source inlet.

3. A vacuum as recited in claim 1, wherein the outer primary filter is a loose fitting large mouth flexible bag formed of a fiberglass material, a neck thereof for receiving a ring clamp that is tightened thereover clamping it onto a footing that is secured to and extends from the lid undersurface.

4. A vacuum as recited in claim 1, wherein the means for sealing the rod means opening through said lid is an elongated sleeve that is capped on one end with the other end for fitting over the rod end and is threaded for engagement with the lid hole.

* * * * *